US006568056B2

(12) United States Patent
Sclippa

(10) Patent No.: US 6,568,056 B2
(45) Date of Patent: May 27, 2003

(54) HOT CONTINUOUS-ROLLING SYSTEM WITH VERTICAL-ROLL STAND

(75) Inventor: Ferruccio Sclippa, Tricesimo (IT)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/076,095

(22) Filed: Feb. 14, 2002

(65) Prior Publication Data

US 2002/0116804 A1 Aug. 29, 2002

(30) Foreign Application Priority Data

Feb. 15, 2001 (IT) ..... PN01A0010

(51) Int. Cl.[7] ..... B23P 17/00; B21B 1/18
(52) U.S. Cl. ..... 29/33 C; 72/203; 72/224
(58) Field of Search ..... 29/33 C; 72/203, 72/204, 224, 225, 226, 227

(56) References Cited

U.S. PATENT DOCUMENTS

| | | | | |
|---|---|---|---|---|
| 5,174,142 A | * | 12/1992 | Pong | 72/8.6 |
| 5,548,986 A | * | 8/1996 | Matsuo et al. | 72/204 |
| 5,626,044 A | * | 5/1997 | Lara-Castro | 72/203 |
| 6,035,682 A | * | 3/2000 | Dorigo | 72/204 |

FOREIGN PATENT DOCUMENTS

| | | | | |
|---|---|---|---|---|
| DE | 40 09 861 | | 10/1991 | |
| EP | 0576930 | A1 * | 1/1994 | 29/33 C |
| JP | 51-46557 | * | 4/1976 | 720/203 |
| JP | 0118272 | * | 10/1978 | 72/203 |
| JP | 57 193205 | | 11/1982 | |
| JP | 60 130401 | | 7/1985 | |
| JP | 61-238405 | * | 10/1986 | 72/224 |

* cited by examiner

*Primary Examiner*—William Briggs
(74) *Attorney, Agent, or Firm*—Herbert Dubno; Andrew Wilford

(57) ABSTRACT

A rolling system has a plant producing a plurality of continuously advancing and parallel hot metal strands, a vertical-roll stand receiving the strands, and a horizontal-roll stand. The vertical-roll stand has an upstream row of vertical pairs of rolls and, immediately downstream therefrom in a movement direction of the strands, a downstream row of vertical pairs or rolls with nips offset laterally from the nips of the upstream row. Every other strand passes by the upstream roll pairs and through the nips of the downstream roll pairs and the remaining strands pass through the nips of the upstream roll pairs and by the downstream roll pairs. The horizontal-roll stand is aligned with the vertical-roll stand and has a pair of horizontal rolls forming a plurality of nips aligned in the direction with the vertical-roll stand nips.

7 Claims, 15 Drawing Sheets

WRL
9
WM
8
TH
bs
7A
6A
7
11
6
bs
4
5
3A
3
2
1
11
10
102
101

WM
9
8
TH
7A
6A
7
6
4
5
3A
3
2
1
11
10
102
101

Fig. 1.1
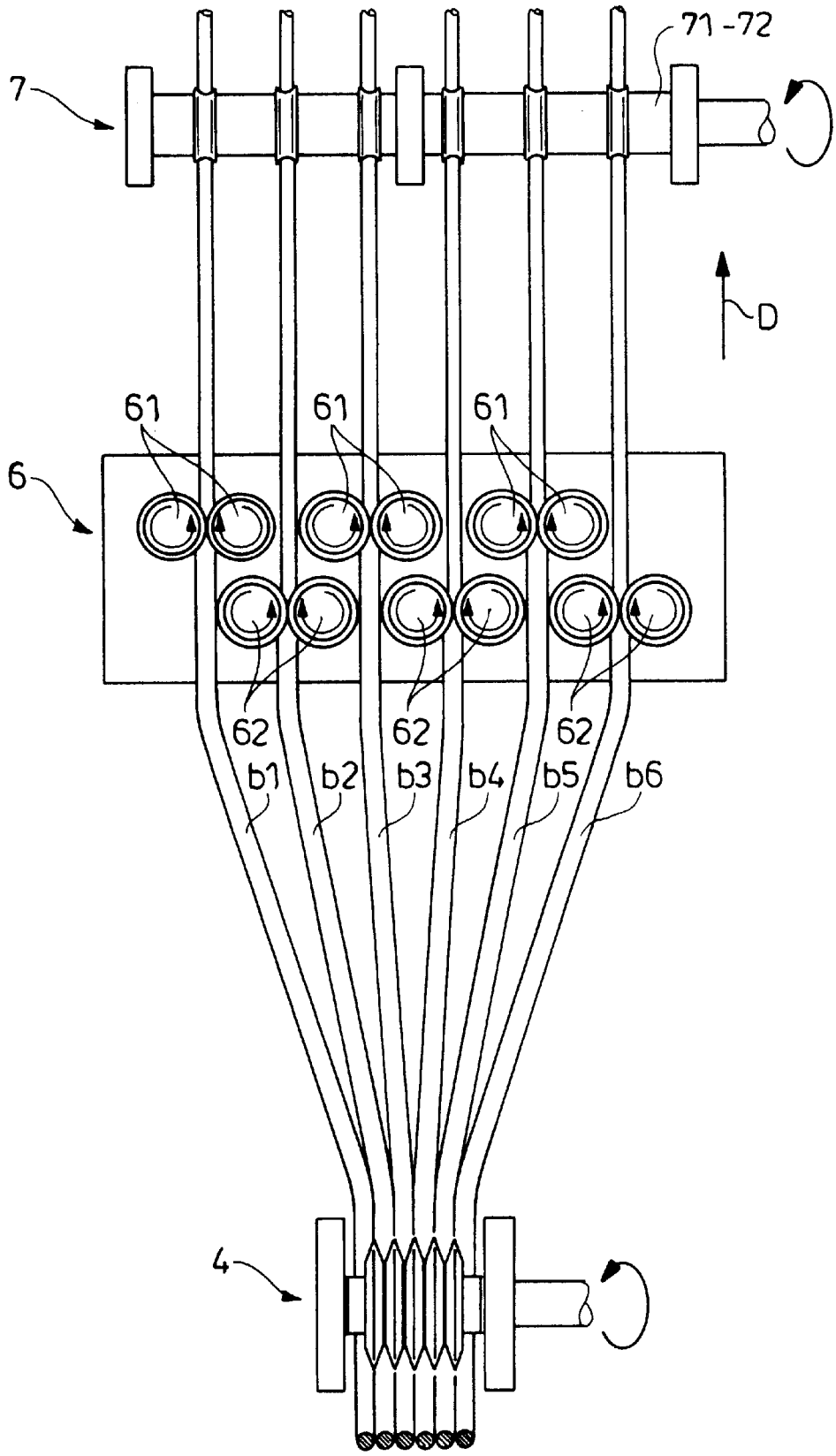

Fig. 2.1
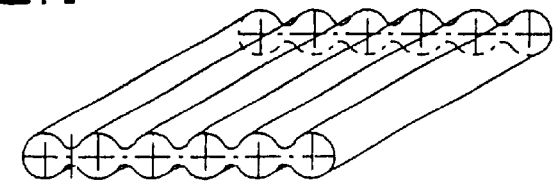
Fig. 3.1
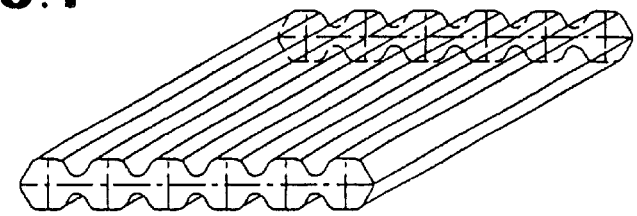
Fig. 3a.1
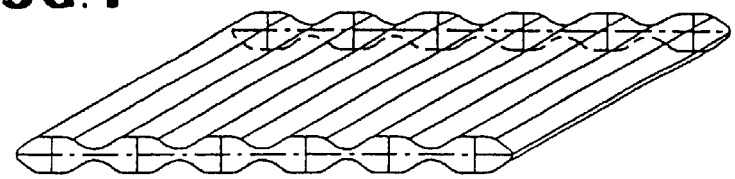
Fig. 4.1
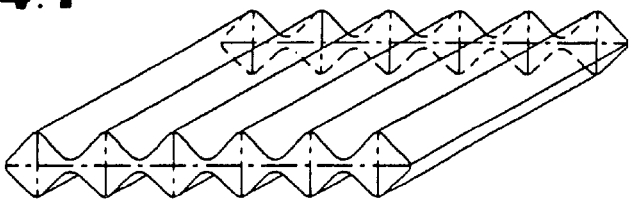
Fig. 5.1
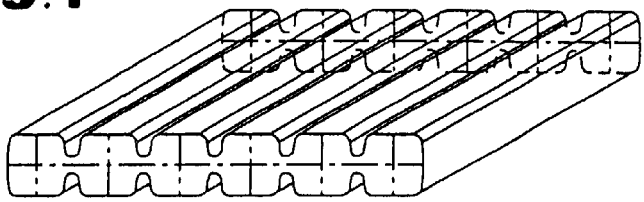
Fig. 6.1
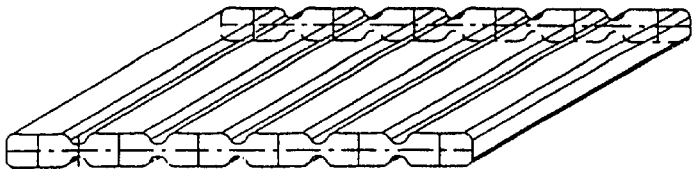

HOT CONTINUOUS-ROLLING SYSTEM WITH VERTICAL-ROLL STAND

FIELD OF THE INVENTION

The present invention relates to a hot continuous-rolling system. More particularly this invention concerns a roll stand with vertical rolls for such a system.

BACKGROUND OF THE INVENTION

It is known to produce rod or wire in a continuous-casting system where molten metal is formed either into a flat strip that is cut longitudinally (see Japanese 60-130401) into a plurality of strands that are then handled jointly in a parallel system, or the strands are directly formed from molten metal and also then handled jointly in a parallel system. Regardless of how the strands are continuously produced from molten metal, they are passed through succeeding vertical- and horizontal-roll stands that reduce the cross-sectional size of each of the strands, with of course simultaneous increase in length, while improving the grain structure and imparting to them the desired cross-sectional shape.

Such rolling of wire and rod is extremely difficult and technical. Output speeds of 30 m/sec to 100 m/sec for straight rod are employed, making the equipment very difficult to control and operate in a continuous process. Beyond a certain speed, production problems become so great that the extra productivity is not really attainable.

In a known system a continuously cast generally square-section billet measuring 160 mm on a side is produced at a rate of 37 ton/h so that it must be rolled at 3 m/min, or 0.05 m/sec. In order to produce from this starting workpiece round-section wire of 8.5 m diameter it is necessary to use 18 rolling stands. The speed into the first roll stand must be three times the casting speed.

In such systems where the finished product is wound up, the EDEMBOR system, and in German 4,009,861 of Hoffmann, it is possible to produce a finished product smaller than 5.5 mm in diameter by using several rolling lines. To do this, however, extremely high speeds are used. Starting with a standard 150 mm×150 mm billet with a starting speed of 0.1 m/sec, it is necessary to accelerate to 300 m/sec by the time it is reduced to a rod 3 mm in diameter. Such speeds are almost impossible to use without jamming. Furthermore the rolling stands must be arranged in two or three lines to achieve the desired finished product, making the overall rolling system very large and requiring technically difficult direction changes.

Japanese 57-193205 process a wide flat strip that is cut into a plurality of parallel rectangular-section strands. They are rolled out, then put through another rolling line before they become the finished product. Thus this process is discontinuous and somewhat slow, having such low productivity as to not represent a significant advantage over the other above-described systems.

U.S. Pat. No. 6,035,682 of Dorigo describes another system where a flat strip is slit longitudinally and rolled into oval-section rods by horizontal rolls that have staggered rolling surfaces that serve to vertically offset adjacent rods from each other as they are being rolled. This system starts with a strip less than 80 mm, preferably 50 mm, in thickness. It must be reheated before rolling. During the rolling the strands must be rotated through 90° so that all edges can be rolled by the succeeding horizontal-roll mills, substantially complicating the operation of the machine. The strip must be rolled out before it is longitudinally slit, producing a longitudinal grain structure that, once slit, impair the strength of the finished workpiece.

OBJECTS OF THE INVENTION

It is therefore an object of the present invention to provide an improved rolling system.

Another object is the provision of such an improved rolling system which overcomes the above-given disadvantages, that is which is capable of producing a finished product at most 5.5 mm in diameter without difficulty.

A further object is to provide an extremely compact rolling system.

SUMMARY OF THE INVENTION

A rolling system has according to the invention a plant producing a plurality of continuously advancing and parallel hot metal strands, a vertical-roll stand receiving the strands, and a horizontal-roll stand. The vertical-roll stand has an upstream row of vertical pairs of rolls and, immediately downstream therefrom in a movement direction of the strands, a downstream row of vertical pairs or rolls. The rows extend parallel to each other and transversely to the strands with each roll pair defining a nip and the nips of the downstream roll pairs staggered transverse to the direction between the nips of the upstream roll pairs. Every other the strand passes by the upstream roll pairs and through the nips of the downstream roll pairs and the remaining strands pass through the nips of the upstream roll pairs and by the downstream roll pairs. The horizontal-roll stand is aligned in the direction with the vertical-roll stand and has a pair of horizontal rolls forming a plurality of nips aligned in the direction with the nips of the vertical-roll stand. The rolls are rotated to draw the strands downstream through the nips.

This rolling system is extremely compact. It subjects the strands to rolling in two orthogonal directions so as to produce a uniform cross-sectional shape and ideal flow of the metal so that the resultant rod is very strong and smooth. Not only is the system very short in the travel direction, but as a result of the staggering of the vertical rolls it is relatively narrow perpendicular to this direction, guiding the strands in a fairly straight line from the location where they are created by casting to the downstream end where the finished product is cut to length or wound on coils.

According to the invention the strands are cast continuously of molten metal. This can be done with a die having a slot-shaped hole configured to produce a flat strip having a plurality of ridges interconnected by thin integral webs. The flat strip is then slit longitudinally at the webs into the strands. Alternately the die has a plurality of separate passages arranged in a line and each producing a respective one of the strands. In the latter case the die passages are curved.

In accordance with the invention the die has at least one throughgoing passage and is formed along the passage with an upstream compartment and a downstream compartment. Coolants at different temperatures are circulated through the compartments so as to control the strand production accurately.

BRIEF DESCRIPTION OF THE DRAWING

The above and other objects, features, and advantages will become more readily apparent from the following description, reference being made to the accompanying drawing in which:

FIG. 1MA is a top view of the system of FIG. 1M;

FIGS. 1.1 and 1.1A are larger-scale top views of the details indicated at respective arrows 1.1 and 1.1A in FIGS. 1 and 1M;

FIGS. 12A through 15A are further views of an alternative drive system for the vertical-roll stand.

SPECIFIC DESCRIPTION

Figures 1, 1A:
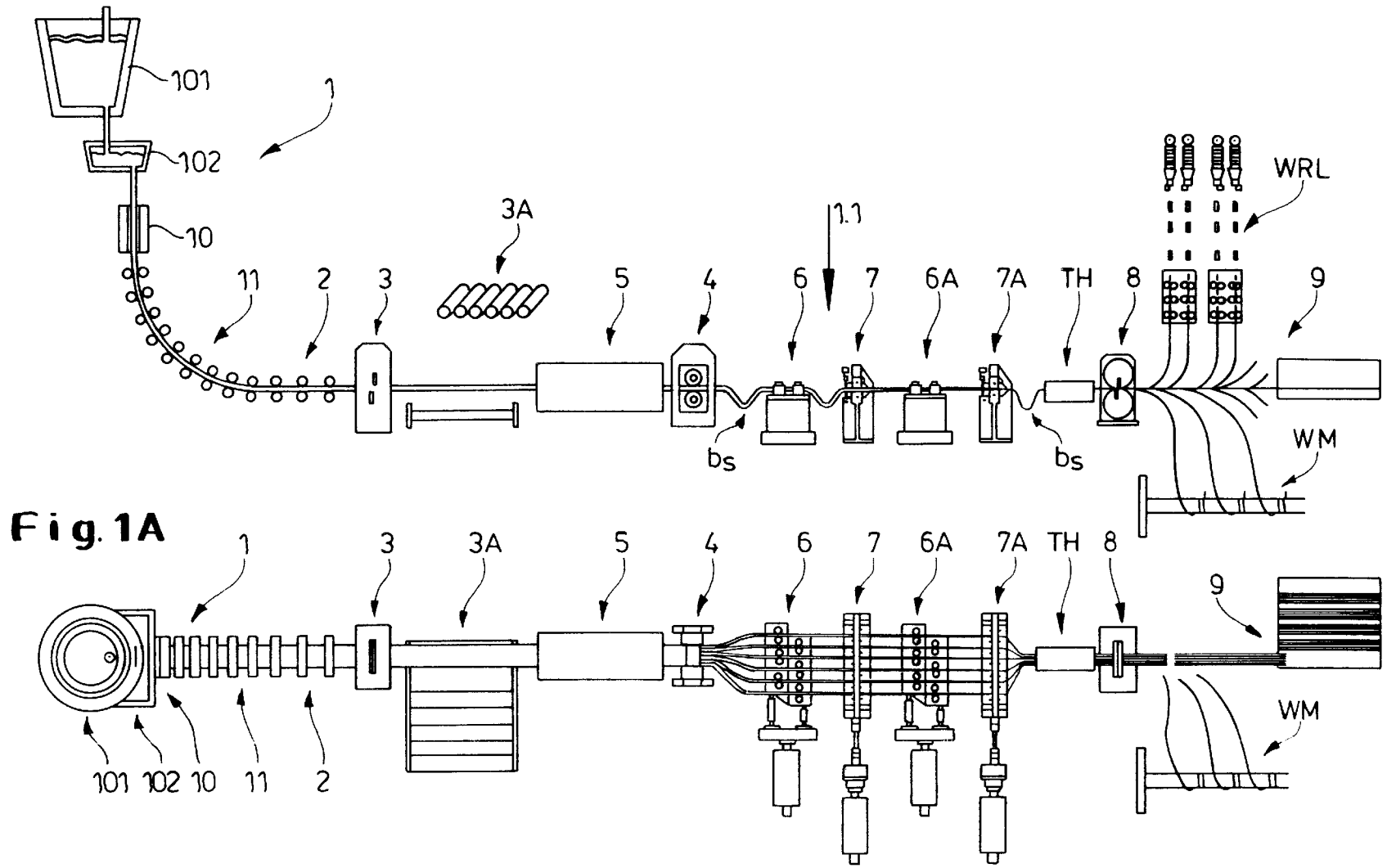
FIG. 1 is a small-scale and partly diagrammatic side view illustrating the rolling system according to the invention.
FIG. 1A is a top view of the system of FIG. 1.

As seen in FIGS. 1 and 1A, continuous-casting plant 1 has a furnace/cauldron 101 feeding a ladle 102 that pours molten steel into the top of an upright die 10. A flat strip moves from a vertical position to a horizontal position in a path 11, being advanced by traction rolls 2. An emergency cross-cutter 3 with a supply of rods 3A is provided as is standard, immediately upstream of a reheating tunnel 5. A slitting unit 4 immediately downstream of the reheater 5 separates the flat strip into a plurality of separate strands that pass parallel to each other horizontally through a vertical-roll stand 6, a horizontal-roll stand 7, a second vertical-roll stand 6A, and a second horizontal-roll stand 7A. Thence the finished rods are cut apart by a chopper 8 and packaged in 6 m or 12 m lengths by a unit 9. A further rolling line WRL or a coiler WM could also be employed. Prior to cutting and or rolling-up, the rod stock can be heat-treated in a unit TH. Of course metals other than steel can be made into rod or wire in the system of this invention. Similarly two rolling lines can be associated with one strand plant 1 so that it can function without interruption.

Figure 1M:
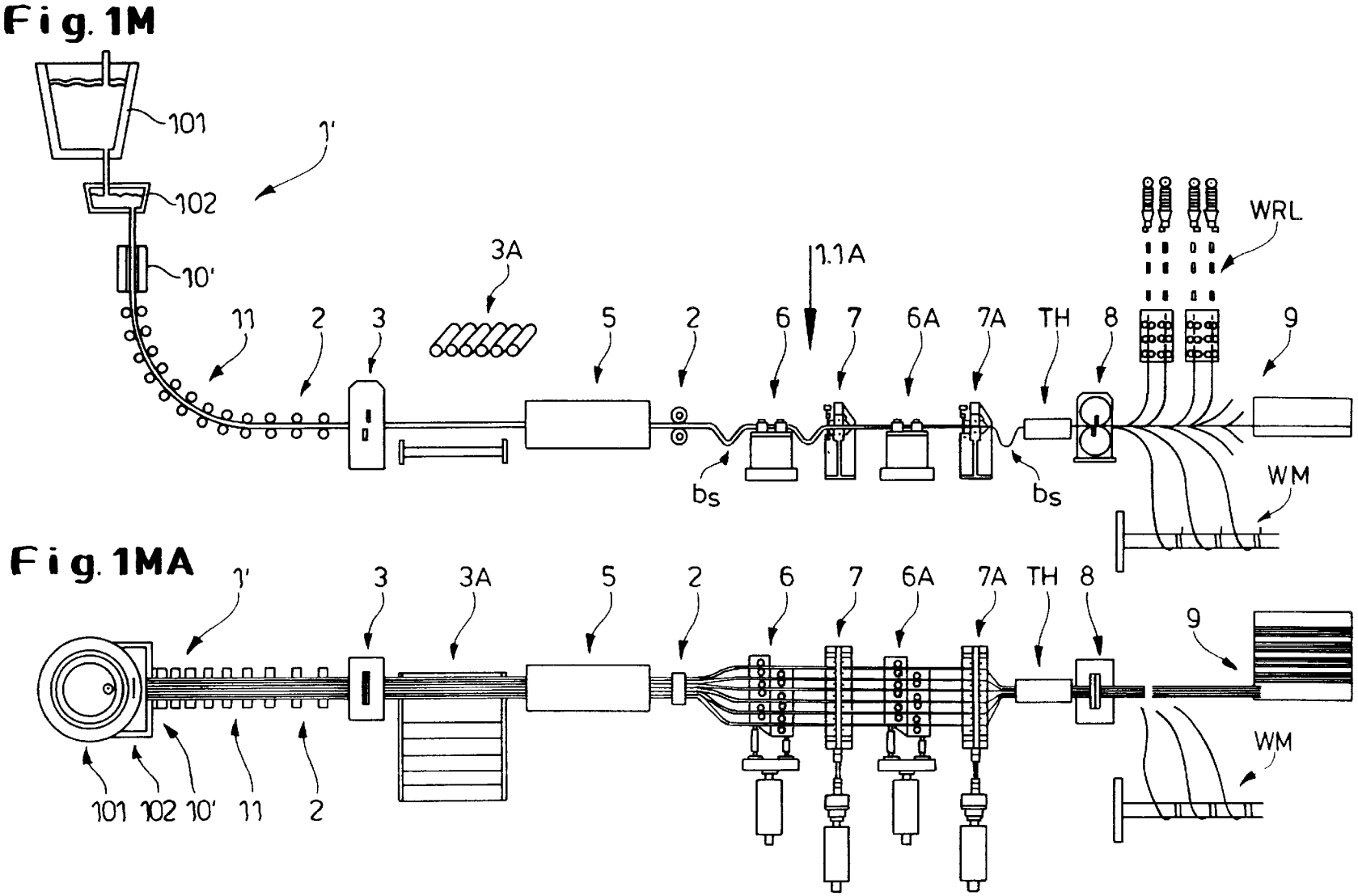
FIG. 1M is a side view of another rolling system in accordance with the invention.
Figure 11A:
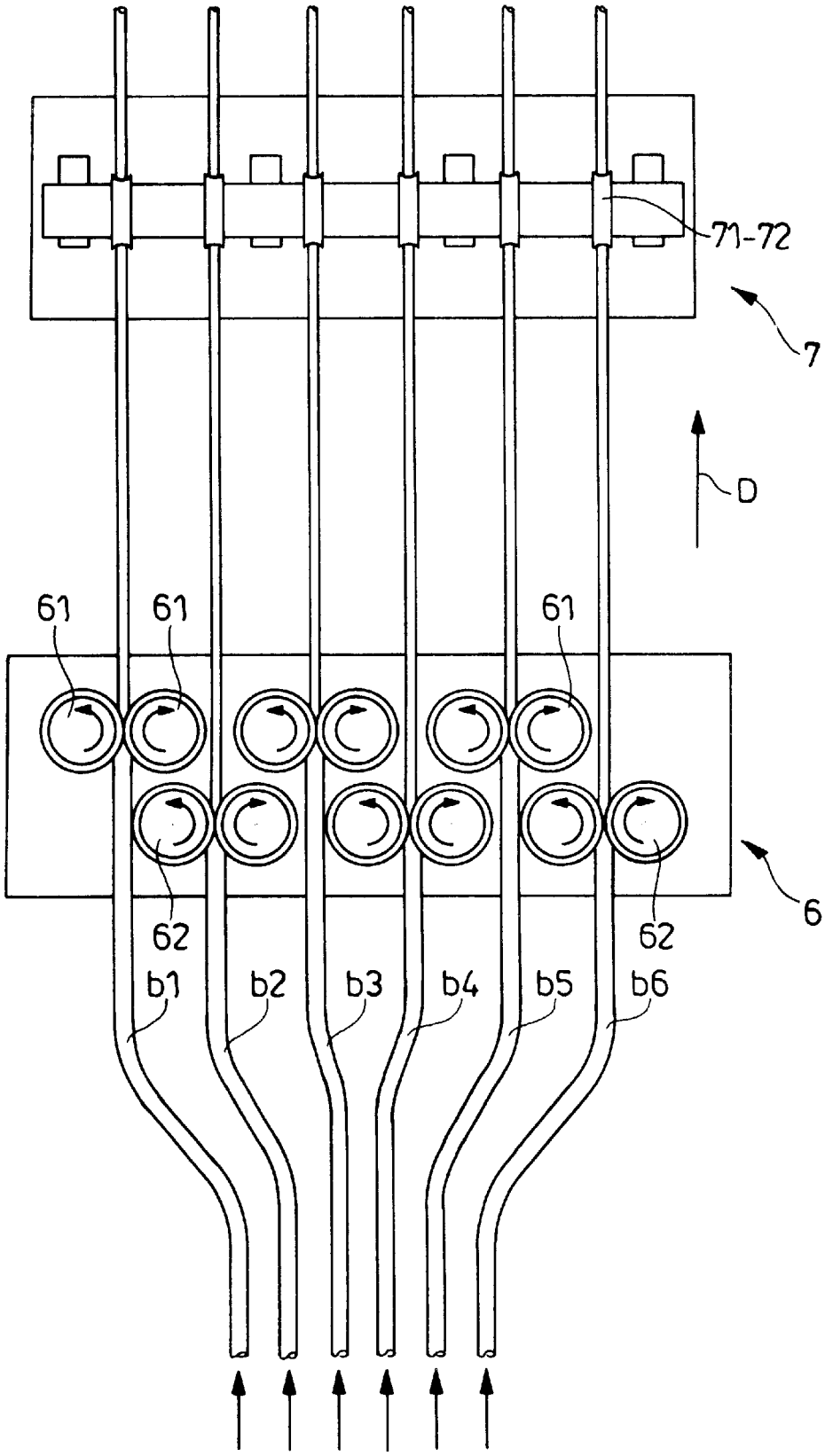
FIG. 11A is a detail top view similar to FIG. 1.1A but showing the drives for the roll stands.
Figure 2:
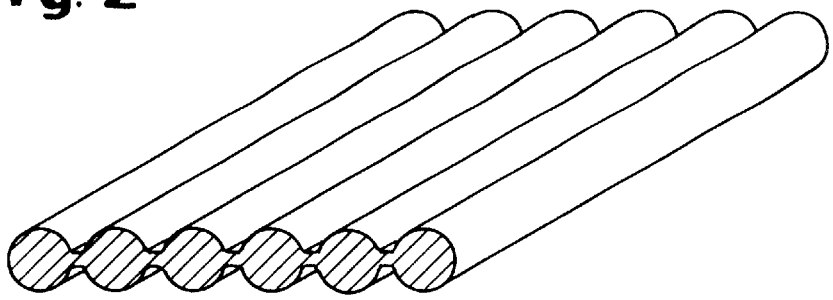
FIGS. 2, 2*a*, 3, 3*a*, 2.1, 3.1, 3*a*.1, 4.1, 5.1, 6.1, 4, 5, and 6 are sectional end views of various workpieces according to the invention at different stages of manufacture.
Figure 2A:
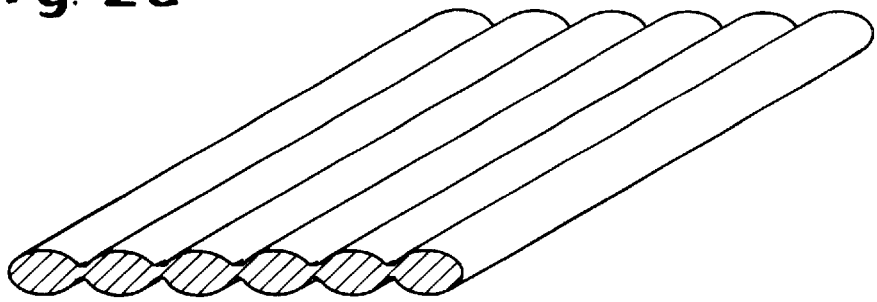
Figure 3:
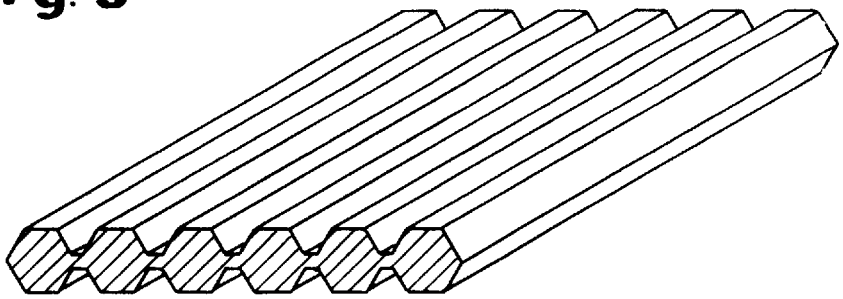
Figure 3A:
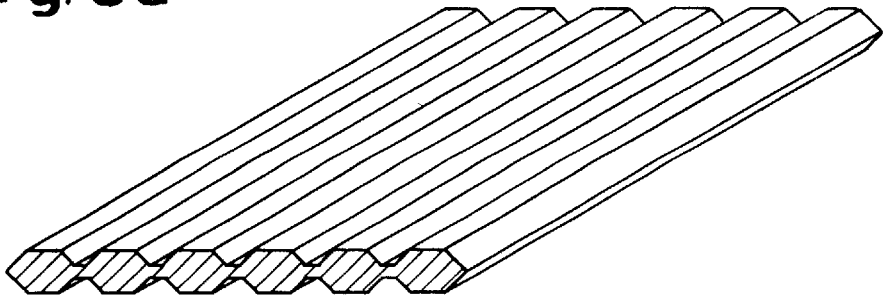
Figure 4:
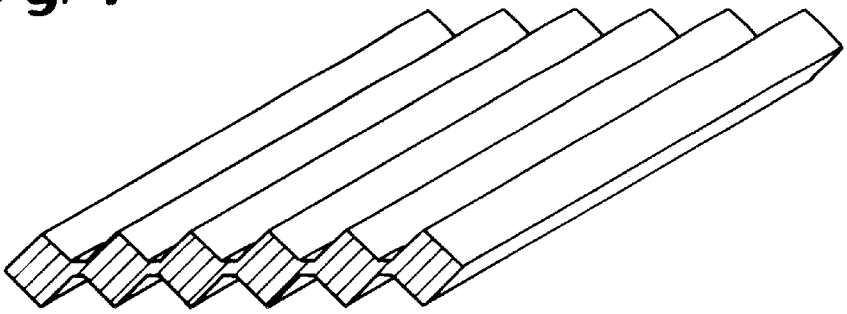
Figure 5:
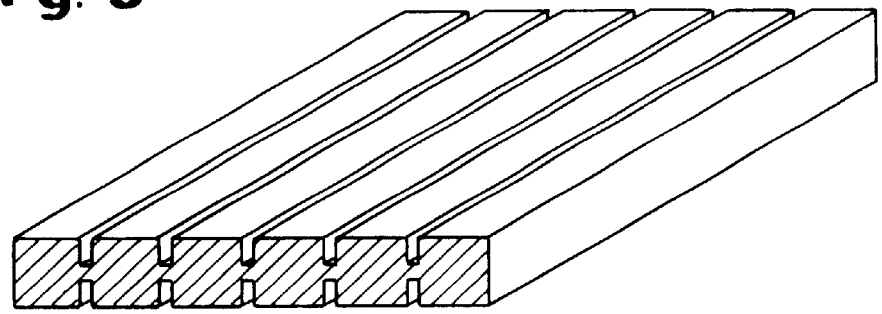
Figure 6:
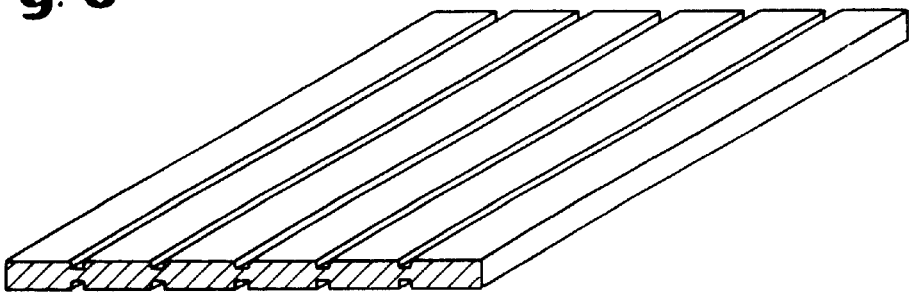
Figure 7:
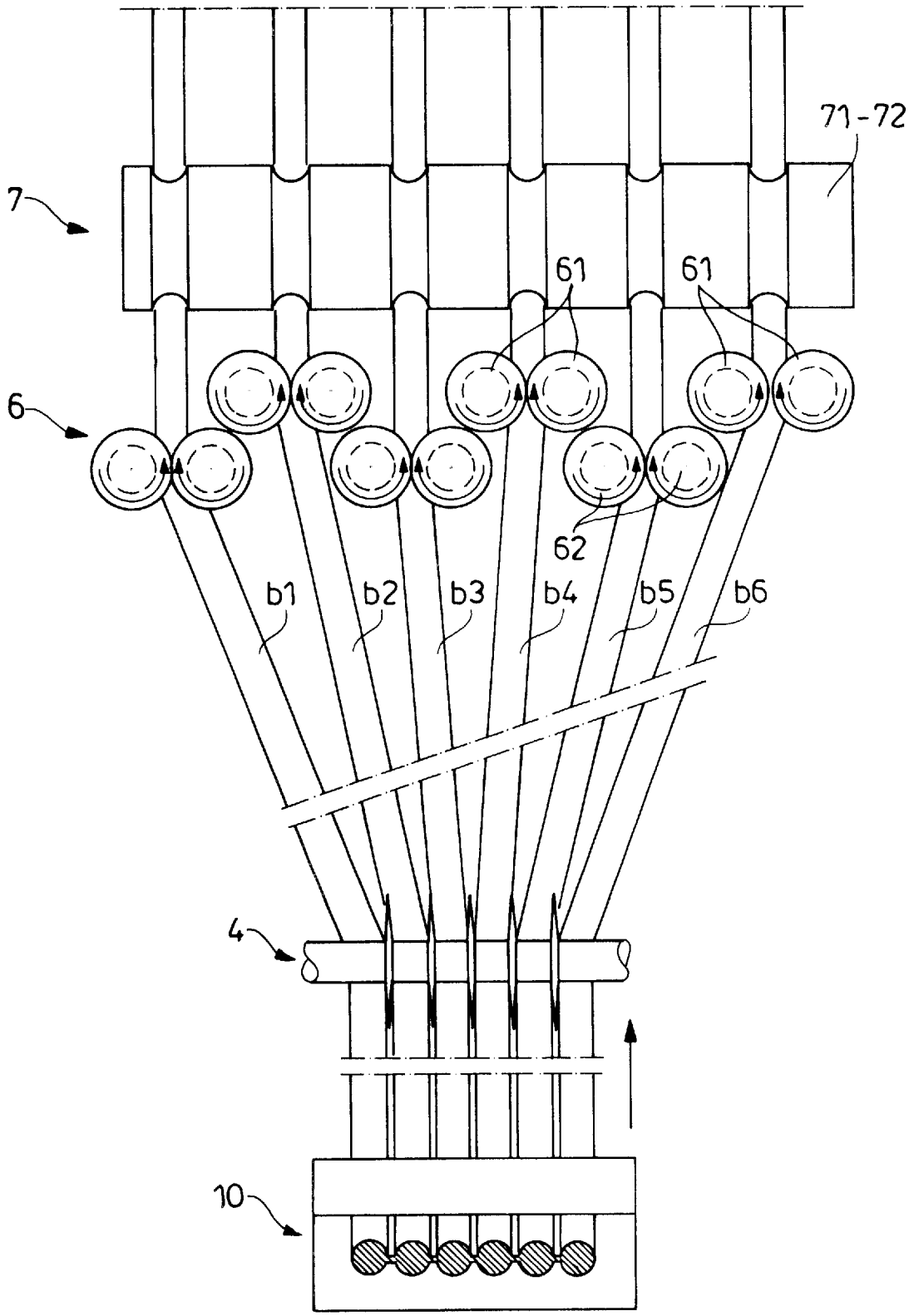
FIG. 7 is a top view generally corresponding to the view of FIG. 1.1.

In FIGS. 1 and 1A the plant 1 produces a flat strip that is cut into independent strands b1, b2, b3, b4, b5, and b6 as shown in FIG. 1.1 and 7, the flat strip having dimensions of 50 mm×800 mm and moving at a speed of 0.1 m/sec. In FIGS. 1M and 1MA the plant 1' has a die 10' that produces a plurality of parallel and separate strands at roughly the same overall size and rate. Thus in FIGS. 1M and 1MA no slitter 4 is needed, but otherwise the two systems are generally identical. At the downstream horizontal-roll stands 7A, 54 8.5-mm diameter rods exit at a speed of 1.25 m/sec for a production rate of about 110 ton/hr. Coils weighing 925 kg are produced.

According to the invention the vertical-roll stands 6 and 6A each comprise two rows of pairs of rolls 61 and 62. There are three downstream pairs of rolls 61 and three upstream pairs of rolls 62 and they are staggered relative to each other to minimize how much the strands b1–b6 have to be spread to pass through them, the nips of the downstream rolls 61 being aligned in the transport direction D with spaces between the pairs of upstream rolls 62 and vice versa. Thus the strands b1, b3, and b5 pass by the rolls 62 and are engaged between the rolls 61 and the strands b2, b4, and b6 pass between the rolls 62 and by the rolls 61. Downstream, the strands b1–b6 pass between a pair of grooved horizontal rolls 71 and 72. This is the same both for separately cast strands and strands that have been longitudinally separated from one another. Loops bs are formed upstream of the upstream vertical-roll stand 6 and downstream of the downstream horizontal-roll stand 7A to compensate for changes in velocity of the strand workpieces as they are rolled to the desired cross-sectional shape.

FIGS. 2 through 6 show how, in the system of FIGS. 1 and 1A, the starting strand can have different cross sections. Each such flat strand comprises a plurality of thick parts of circular, oval, or polygonal section, joined by thin parts or webs that are severed through at the slitter 4. The cross-sectional shapes are of course reduced and refined as the workpieces move downstream.

Figure 8:
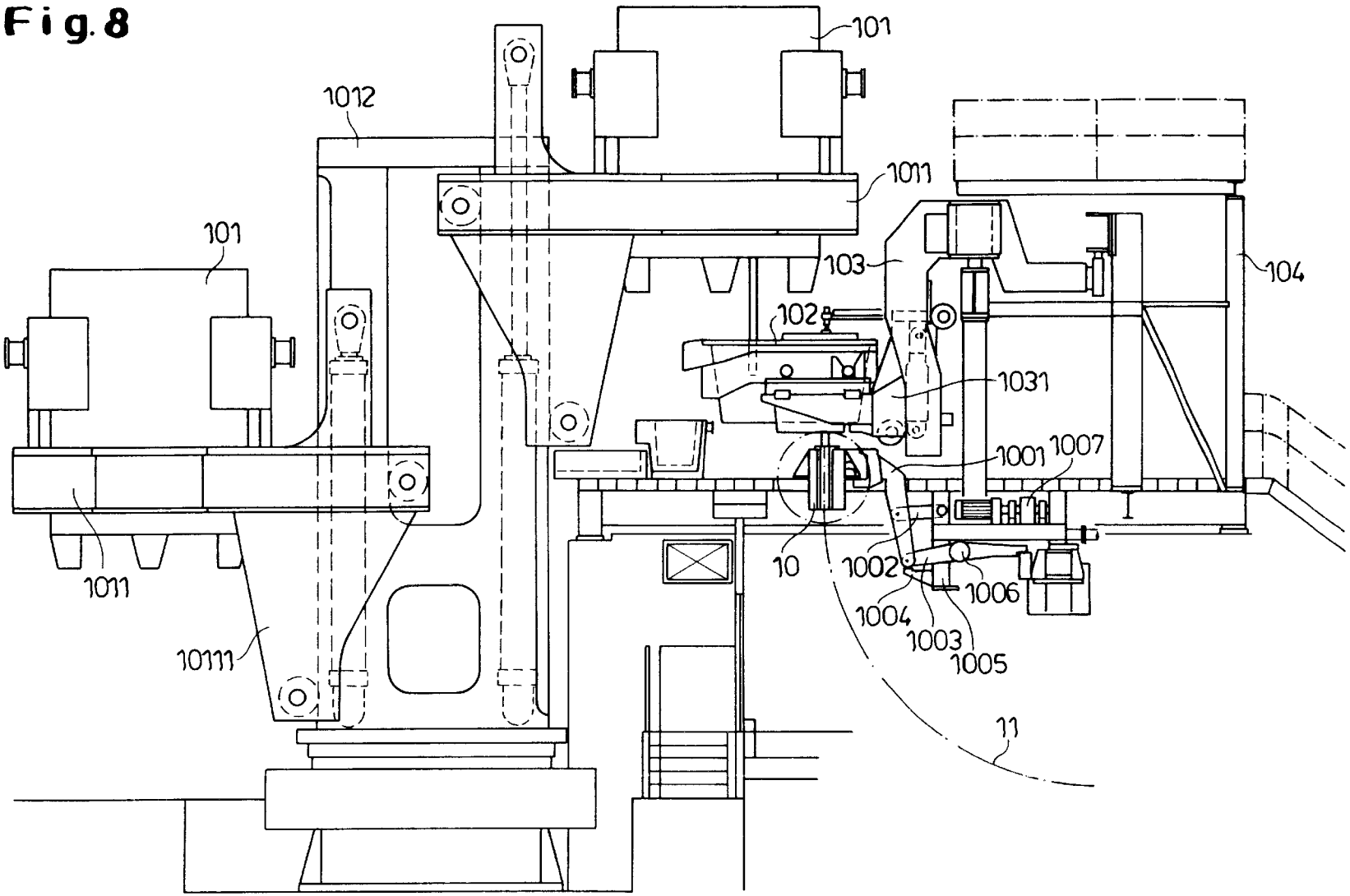
FIG. 8 is a very small-scale side view of the upstream portion of the rolling system.

In FIG. 8, the cauldron 101 and ladle 102 are shown supported on movable structure 1011, 10111, and 1012. Further strand-guide elements 103 and 1031 are provided that are supported on a lateral bridge structure 104. Movable levers 101, 1002, 1003 1004, 1005, and 1006 having a motor 1007 are used to move the ladle 102.

Figure 10:
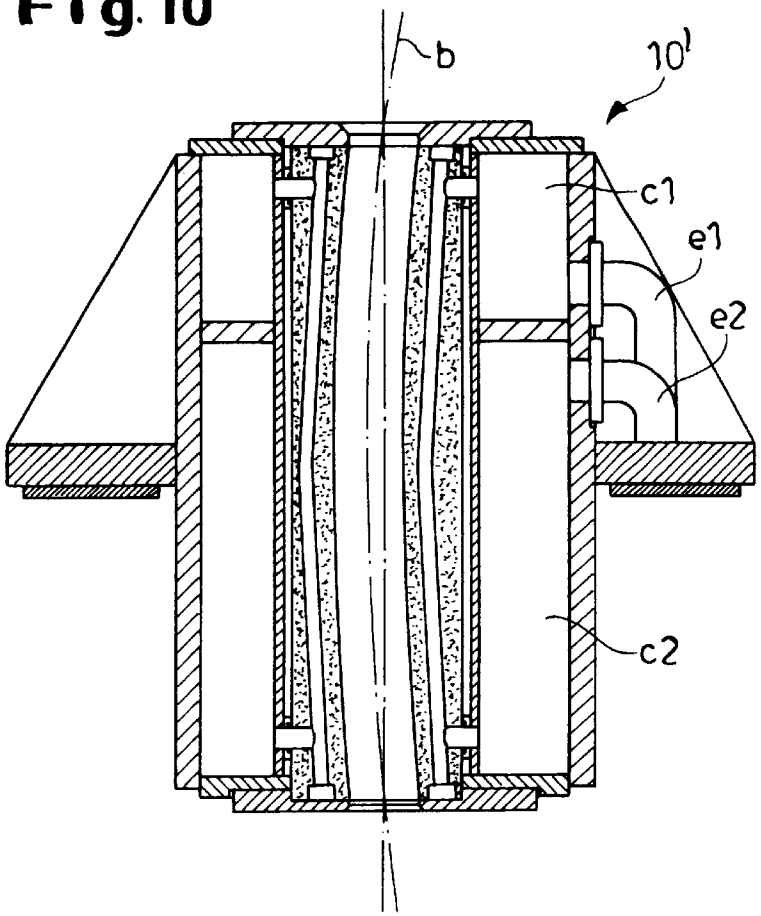
FIG. 10 is a vertical cross-section through the die.
Figure 9:
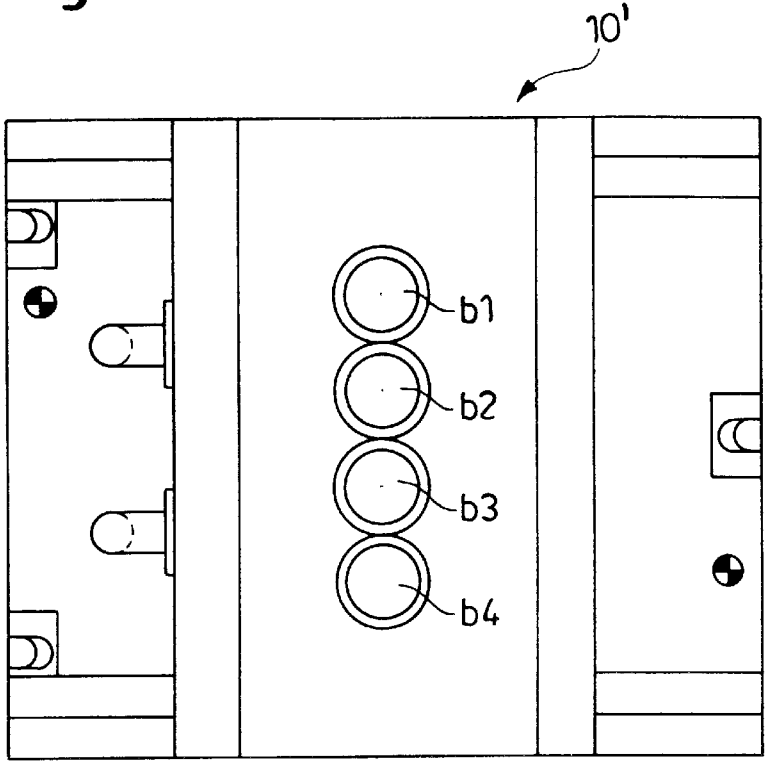
FIG. 9 is a top view of the die of the rolling system.
Figure 11:
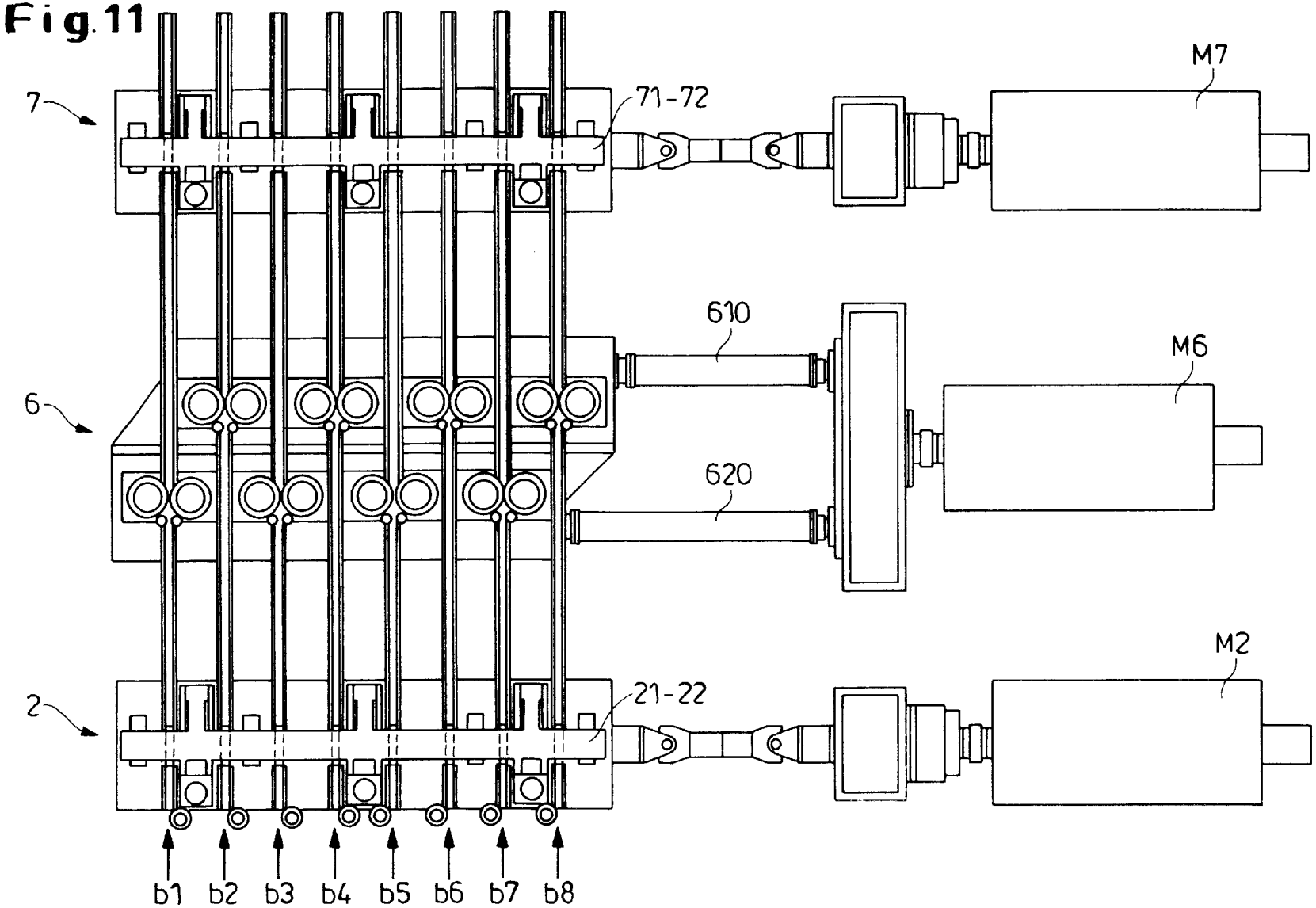
FIG. 11 is a detail top view similar to FIG. 1.1 but showing the drives for the roll stands.
Figure 11A:
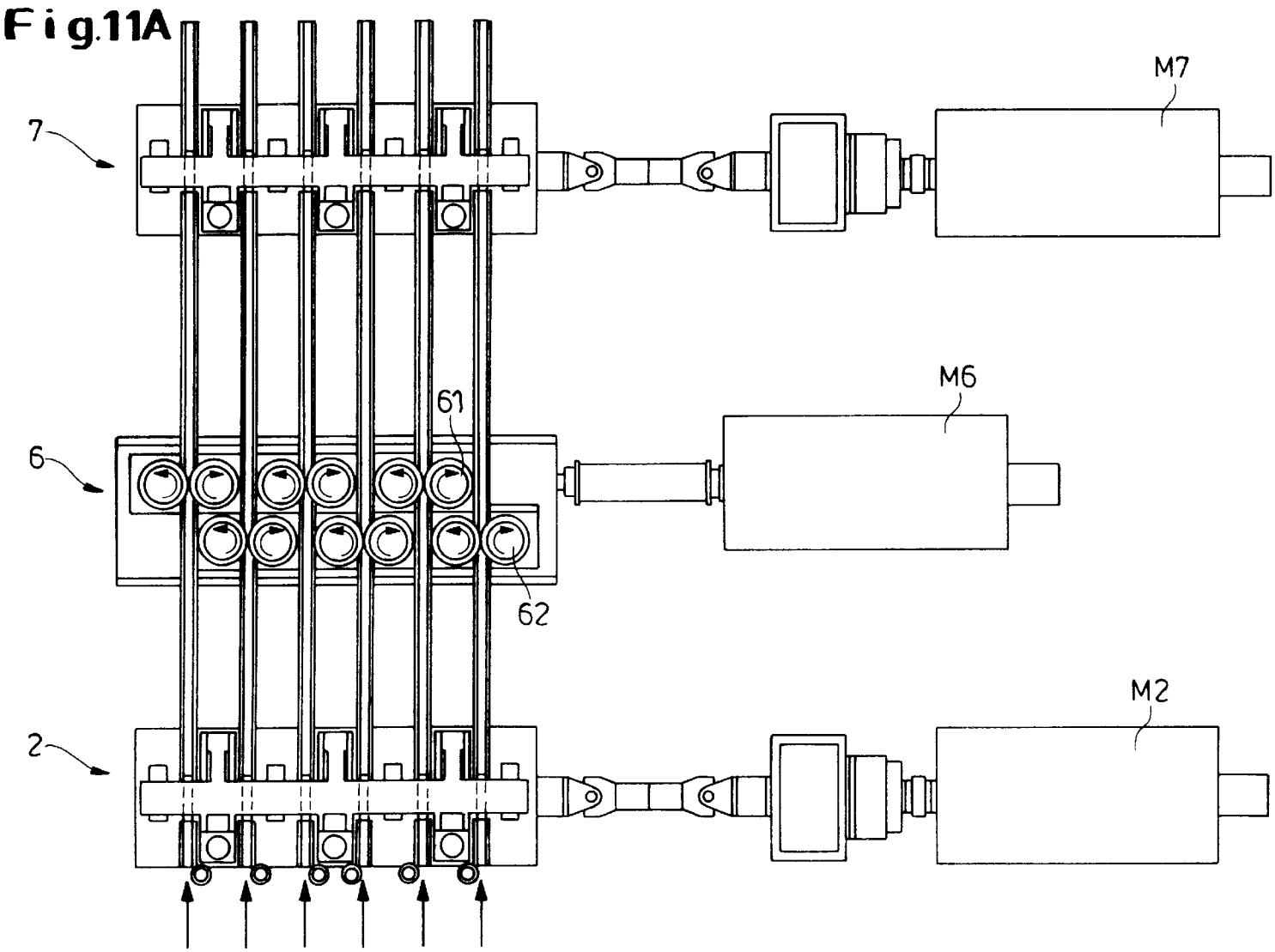
Figure 12:
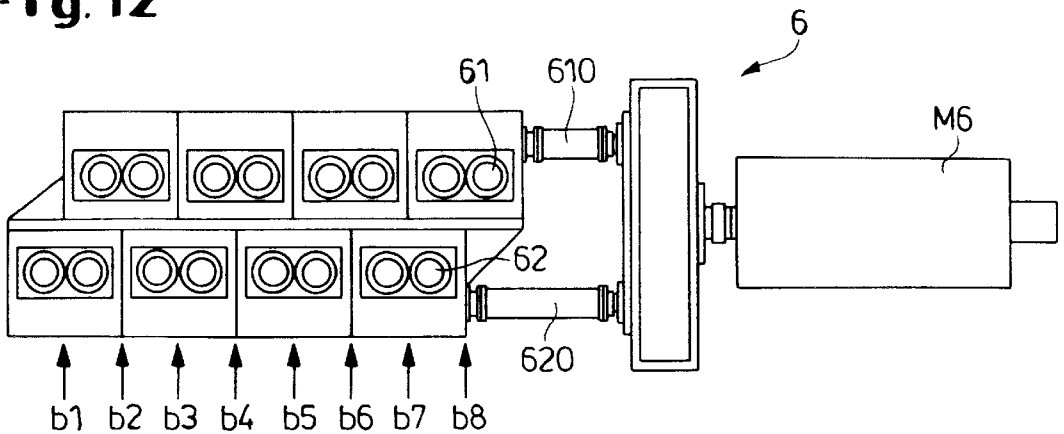
FIGS. 12 through 15 are top, end, side, and sectional views further showing the drive for the vertical-roll stand.

FIGS. 9 and 10 show the die 10' that produces, instead of a flat ribbed strand as shown in FIGS. 2 through 6, a plurality of parallel but totally separate strands b1–b4. It has as shown a short upper cooling compartment c1 and a longer downstream cooling compartment c2 fed by respective supply lines e1 and e2. The passages through the die 10/are arcuate, extending along a gently curved line or path b.

Figure 14:
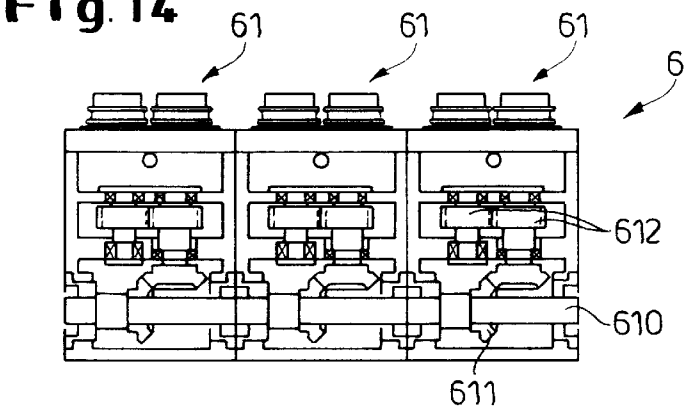
Figure 15:
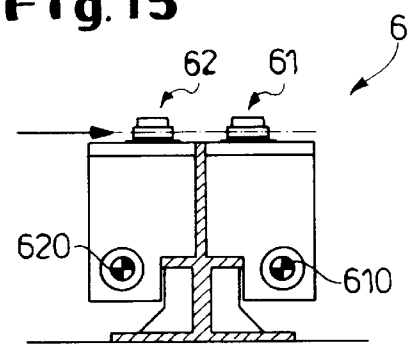
Figure 13:
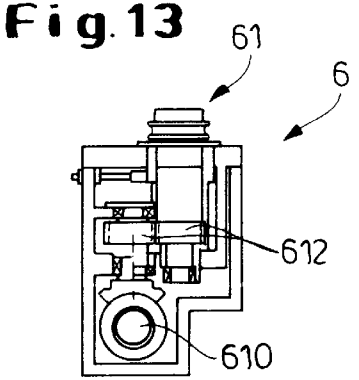
Figure 14A:
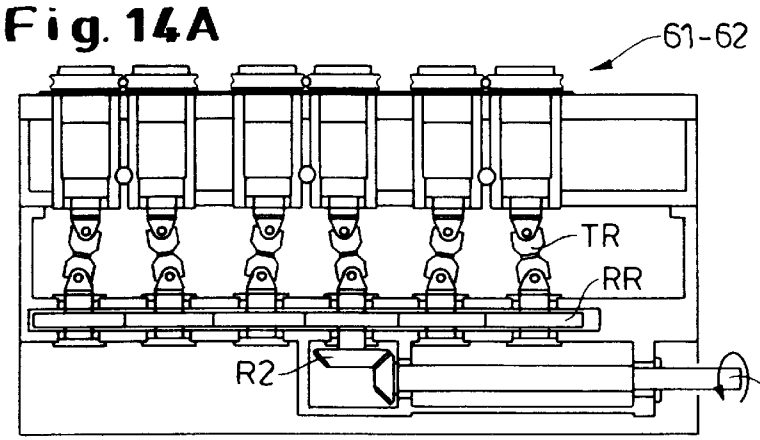
Figure 12A:
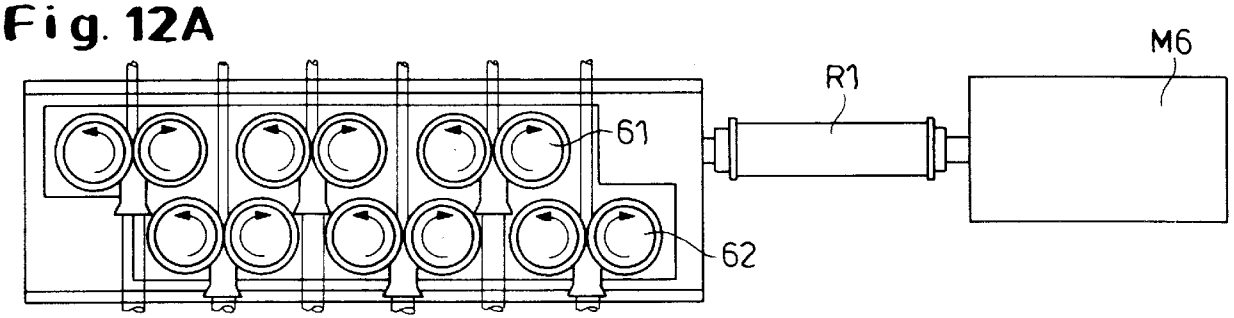
Figure 13A:
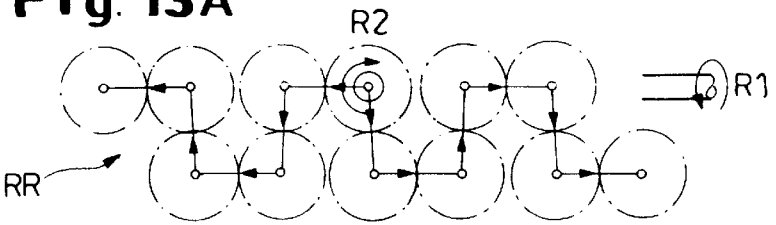
Figure 15A:
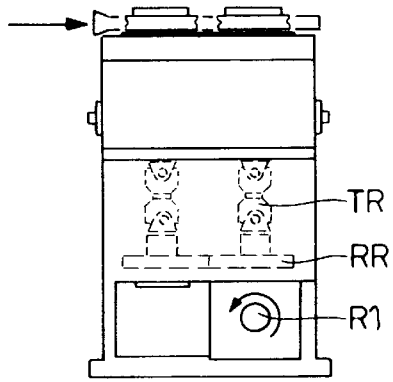

FIGS. 11–14 shows a system where three separate motors M2, M6, and M7 drive the traction rolls 21 of the unit 2, the rolls 61 and 62 of the vertical-roll stand 6, and the rolls 71 and 72 of the horizontal-roll stand 7. Here eight separate strands b1–b8 are rolled. Separate shafts 610 and 620 drive the rolls 61 and 62. FIG. 14 shows how the shaft 610 carries a gear 612 that meshes with an identical such gear on the other roll 61 of the pair. In addition bevel gearing 611 connects the rolls 61 in the line. A similar setup is used for the rolls 62.

In FIGS. 11A through 15A the motor M6 is connected through a single shaft R1 with a central bevel gear R2 and thence to a chain of gears RR in turn connected via cardan joints TR to the rolls 61 and 62. The single motor M6 drives all the rolls 61 and 62.

Figure 16:
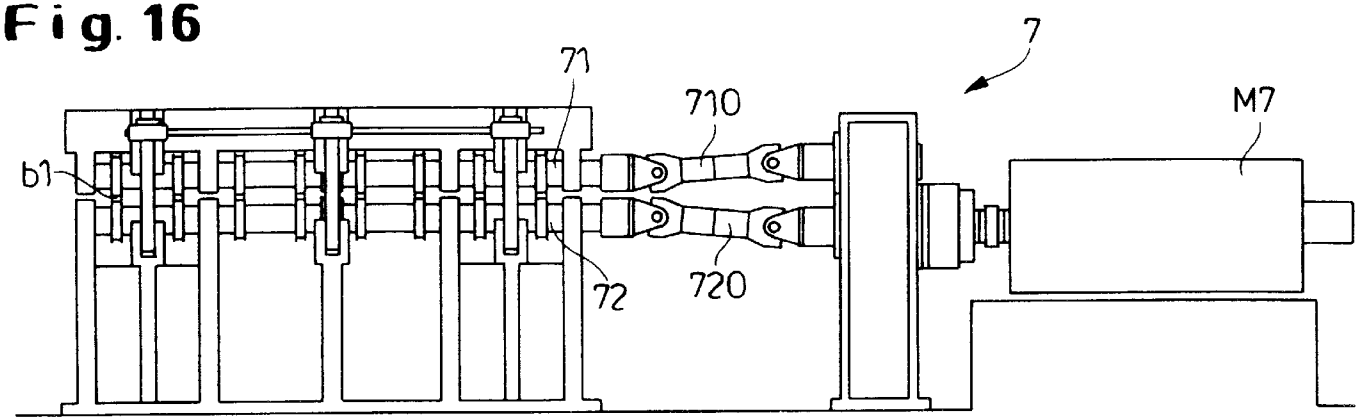
FIGS. 16, 17, and 18 are side, top, and end views of the drive for the horizontal-roll stand.
Figure 17:
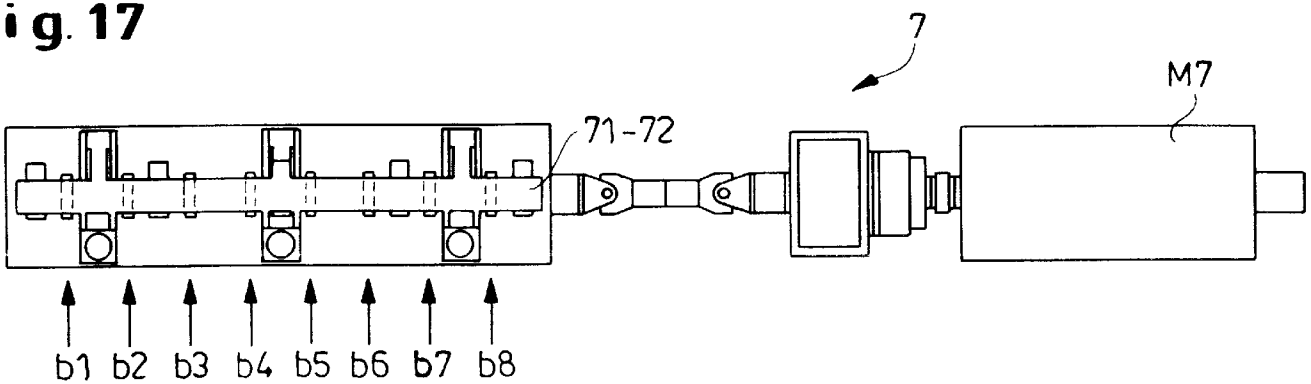
Figure 18:
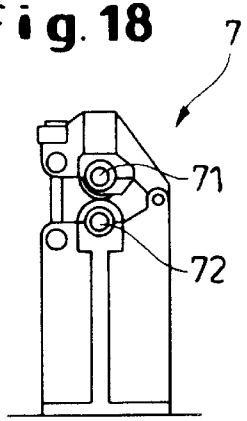

FIGS. 16 through 18 show the horizontal-roll stand 7 and its motor M7. Here two shafts 710 and 720 are connected to the two rolls 71 and 72. Once again, a single motor M7 drives both rolls 71 and 72.

If two or three rolling lines are used, wire or rod of less than 5.5 mm in diameter can be produced with an output speed of 60–70 m/sec, that is five times slower than the standard single-line speed of 300 m/sec.

I claim:

1. A rolling system comprising:

means for producing a plurality of continuously advancing and parallel hot metal strands;

a vertical-roll stand receiving the strands and having an upstream row of vertical pairs of rolls and, immediately downstream therefrom in a movement direction of the strands, a downstream row of vertical pairs of rolls, the rows extending parallel to each other and transversely to the strands, each roll pair defining a nip and the nips of the downstream roll pairs being staggered transverse to the direction between the nips of the upstream roll pairs, some of the strands passing by the upstream roll pairs and through the nips of the downstream roll pairs and the remaining strands passing through the nips of the upstream roll pairs and by the downstream roll pairs;

a horizontal-roll stand aligned in the direction with the vertical-roll stand and having a pair of horizontal rolls forming a plurality of nips aligned in the direction with the nips of the vertical-roll stand; and means for rotating the rolls and drawing the strands downstream through the nips.

2. The rolling system defined in claim 1 wherein the means for producing includes means for casting the strands continuously of molten metal.

3. The rolling system defined in claim 2 wherein the means for casting includes a die having a slot-shaped hole configured to produce a flat strip having a plurality of ridges interconnected by thin integral webs, the means for producing further comprising:

means for slitting the flat strip longitudinally at the webs into the strands.

4. The rolling system defined in claim 2 wherein the means for casting includes a die having a plurality of separate passages arranged in a line and each producing a respective one of the strands.

5. The rolling system defined in claim 4 wherein the passages are curved.

6. The rolling system defined in claim 2 wherein the means for casting includes a die having at least one through-going passage and formed along the passage with an upstream compartment and a downstream compartment, the rolling system further comprising:

means for circulating respective coolants through the compartments.

7. The rolling system defined in claim 1, further comprising means for forming loops in the strands upstream and downstream of the stands.

* * * * *